US011044561B2

(12) United States Patent
Sancisi

(10) Patent No.: US 11,044,561 B2
(45) Date of Patent: Jun. 22, 2021

(54) ACOUSTIC PANEL ASSEMBLY WITH SUSPENSION SYSTEM

(71) Applicant: ASK INDUSTRIES SOCIETA' PER AZIONI, Monte San Vito (IT)

(72) Inventor: Carlo Sancisi, Chiaravalle (IT)

( * ) Notice: Subject to any disclaimer, the term of this patent is extended or adjusted under 35 U.S.C. 154(b) by 0 days.

(21) Appl. No.: 16/691,089

(22) Filed: Nov. 21, 2019

(65) Prior Publication Data

US 2020/0186928 A1 Jun. 11, 2020

(30) Foreign Application Priority Data

Dec. 10, 2018 (IT) ..... 102018000010947

(51) Int. Cl.
*H04R 7/04* (2006.01)
*H04R 7/06* (2006.01)
*H04R 7/20* (2006.01)

(52) U.S. Cl.
CPC ..... *H04R 7/045* (2013.01); *H04R 7/06* (2013.01); *H04R 7/20* (2013.01); *H04R 2440/05* (2013.01)

(58) Field of Classification Search
CPC ..... H04R 2440/00–07; H04R 1/00; H04R 2205/022; H04R 2201/401; H04R 2201/405
USPC ..... 381/152, 182
See application file for complete search history.

(56) References Cited

U.S. PATENT DOCUMENTS

| | | | | |
|---|---|---|---|---|
| 5,025,474 | A | 6/1991 | Tanaka et al. | |
| 6,377,145 | B1 | 4/2002 | Kumagai | |
| 9,769,572 | B2 * | 9/2017 | Jiang | H04R 9/063 |
| 2002/0191807 | A1 * | 12/2002 | Asada | H04R 5/02 381/335 |
| 2003/0081800 | A1 | 5/2003 | Klasco et al. | |
| 2013/0272550 | A1 * | 10/2013 | Furuichi | H04M 19/047 381/152 |
| 2016/0381461 | A1 | 12/2016 | Clark et al. | |

OTHER PUBLICATIONS

Search Report and Written Opinion dated Jul. 19, 2019 with reference to the priority Italian Patent Application No. 102018000010947.

* cited by examiner

*Primary Examiner* — Suhan Ni
(74) *Attorney, Agent, or Firm* — Egbert, McDaniel & Swartz, PLLC

(57) ABSTRACT

An acoustic panel assembly has only one acoustic panel with a back surface, a frame that peripherally surrounds the acoustic panel, a support integral with the frame, only one magnetic unit fixed to said support, only a voice coil fixed to the acoustic panel, a supporting structure integral with the frame, and a plurality of springs connected to the supporting structure. The springs are connected in different points of the back surface of the acoustic panel in such a way to elastically support the acoustic panel.

9 Claims, 9 Drawing Sheets

ACOUSTIC PANEL ASSEMBLY WITH SUSPENSION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention refers to an acoustic panel assembly with a suspension system.

2. Description of Related Art Including Information Disclosed Under 37 CFR 1.97 and 37 CFR 1.98

Acoustic panels, which are also defined as Distributed Mode Loudspeakers (DMLs), reproduce the sound in a wide range of audio frequencies, in the so-called "distributed mode", generating bending waves that propagate on the structure/body of the panel. The acoustic response is generated by the bending and rippling of the panel, which are distributed in the range of audio frequencies produced by an excitation device and transmitted in the air.

Evidently, with such an operation and sound generation mechanism, the choice of the characteristics of the materials used for the panel, in terms of rigidity, dampening and self-noise, is fundamental in order to obtain an audio response with good quality and high fidelity.

An appreciated characteristic of DML panels, which makes them different from loudspeakers, is the fact that they emit a diffused, non-directional sound field over a wide audio frequency range; on the contrary, acoustic panels are generally impaired by a poor reproduction of low frequencies.

As it is known, up to a given transition frequency, depending on the dimensions (diameter) of the membrane, the movement of the membrane of a loudspeaker is equivalent to a pistonic movement, i.e. all points of the membrane are moved in phase.

For frequencies higher than the transition frequency, the sounds are reproduced by means of bending and rippling of the membrane, which tend to "color" the sound, reducing its fidelity, occasionally in a disturbing way. Evidently, also in this case, a correct choice of the materials is fundamental to characterize the sound and ensure its fidelity.

As it is known, traditional DML panels are stressed by means of exciters/shakers that are directly fixed to the body of the sound panel. The most common materials used for the panels are of laminated, composite type, typically with honeycomb structure, comprising a honeycomb core disposed between two sheets/laminated surfaces, defined as "skins".

The acoustic panels are characterized by the fact that they have a low thickness, unlike the loudspeakers with cone membrane. Acoustic panels are preferred, because of such a characteristic, and are practically the only solution in case of mounting in shallow spaces.

Such a mechanical requirement is particularly important in case of installation in vehicles, which generally have shallow spaces in doors, in the backrest seat, in the car roof/headliner, in the pillars that are used for fixing the windscreen and in the dashboard.

FIG. 1 illustrates an acoustic panel assembly (100) according to the prior art. A magnetic unit (1) is supported by a bridge-shaped bracket (2) that is firmly connected to an external peripheral frame (3) that supports an acoustic panel (4) by means of perimeter suspensions (5) generally consisting in an elastic edge. A mobile voice coil (6) is firmly connected to the acoustic panel (4) by means of a cylindrical voice coil former (60). The voice coil (6) is free to move inside a gap (T) generated by the magnetic unit (1). When the voice coil (6) is crossed by electrical current, it receives a force (Lorentz force) in the gap (T) that determines its axial movement. The magnetic unit (1) is mounted in the center of the panel although it is preferably disposed out of the center of the panel according to the prior art.

FIG. 2 illustrates several embodiments of elastic perimeter suspension, which are known from the loudspeaker technology and can be used in the acoustic panels such as the one of FIG. 1. FIG. 2*a* illustrates a perimeter suspension (5*a*) with an M-shaped section; FIG. 2*b* illustrates a perimeter suspension (5*b*) with a semi-circular section with outward concavity; FIG. 2*c* illustrates a perimeter suspension (5*c*) with a semi-circular section with inward concavity; FIGS. 2*d* and 2*e* illustrate suspensions (5*d*, 5*e*) obtained from a foam cloth and disposed around the perimeter of the acoustic panel (4); FIG. 2*f* illustrates a suspension (5*f*) that comprises two supports (50) consisting in elastic tubular elements that are filled with air and disposed above and under the acoustic panel (4).

The perimeter suspensions can be co-molded, placing the acoustic panel in a mold and injecting injectable elastomer materials, such as rubber, silicone or foam. Alternatively, the perimeter suspensions can be made separately and glued on the perimeter of the panel with adhesives.

Moreover, perimeter suspensions can be made from fabrics that are treated with resin and are suitably hot-pressed in order to obtain the requested geometries. Furthermore, only some perimeter regions of the acoustic panel may be elastically suspended, according to the acoustic features determined by the project requirements.

US2003/0081799 discloses suitable materials for improving the sound produced by the acoustic panels in order to obtain: a better signal/noise ratio (S/N), a better extension in the frequency response, especially at low frequency, and a better power handling.

US2003/0081800 discloses an excitation and suspension system of an acoustic panel, by means of techniques that are known for the realization of traditional loudspeakers, additionally improving the acoustic response, especially at low frequency. In this way, a hybrid acoustic system that operates as Distributed Mode Loudspeaker (DML) for electrical signals with limited power is obtained. On the contrary, because of the elastic suspension system of the external perimeter border, the acoustic panel operates in pistonic mode for high volume levels and especially for low frequencies.

In order to make the acoustic response more regular, the magnetic unit is disposed in a non-central position of the acoustic panel, thus contributing to an unstable movement (pitching) of the panel that tends to displace the panel in a non-parallel direction to its axis in idle condition. The elastic perimeter suspensions disclosed in US2003/0081800, in the practical embodiments, do not guarantee a stable axial movement of the acoustic panel, with the risk for the voice coil to scrape the gap during operation, causing a sound distortion.

Such a drawback is partially solved by U.S. Pat. No. 9,660,596, which discloses a complex configuration that uses more than one magnetic unit (more than one excitation point) in order to make the axial movement of the acoustic panel more stable. The use of multiple magnetic units is an attempt to cancel the mechanical moments caused by the excitation forces that act relative to the axes that pass through the center of the panel. In fact, said mechanical moments would tend to move the panel with movements that are not parallel to its axis (pitching).

U.S. Pat. No. 5,025,474 discloses a loudspeaker system with an image projection screen connected to a rear acoustic cabinet. The loudspeaker system comprises a plurality of acoustic panels that are connected one to another and to a frame with typical U-shaped elastic perimeter suspensions. Each acoustic panel is excited by a traditional driver comprising a magnetic unit and a voice coil. The acoustic panels have different dimensions in order to reproduce different audio frequency bands. A portion of the cabinet, which can be open or closed, is situated behind the acoustic panels. Such a document intends to obtain the best open/closed ratio of the cabinet according to the distance of the acoustic panels from a wall. Traditional suspension and centering systems connected to the voice coil are used in the gaps, in order to make the movements of the panels compatible with the corresponding displacements of the voice coils of the drivers.

U.S. Pat. No. 5,025,474 does not disclose springs connected to a supporting structure and in different points of the surface of the acoustic panel. U.S. Pat. No. 5,025,474 discloses elastic elements made of silicone rubber, disposed between the edges of two adjacent acoustic panels. Said elastic elements do not have the rigidity of a spring and do not act as springs. The elastic elements are used to elastically connect the various panels, whereon the image projection screen is fixed, in such a way to obtain a smooth surface, reduce the relative displacements of the panels and avoid the deformation of the images projected on the screen.

In fact, it must be considered that the loudspeaker system of U.S. Pat. No. 5,025,474 has a total radiant surface of 70 inches and needs minimum displacements in a range comprised between +/−0.3 mm and +/−0.5 mm to achieve a considerable sound pressure level of 100 dB/m. Therefore, such a loudspeaker system does not need regular wide movements of the surface of each acoustic panel, and consequently cannot be provided with springs that control wide movements of the panel and, obviously, does not provide any precepts about how to control the wide movements of the surface of the panel in different points of the panel.

BRIEF SUMMARY OF THE INVENTION

The purpose of the present invention is to eliminate the drawbacks of the prior art by disclosing an acoustic panel with suspension system that avoids the use of multiple magnetic units, permitting a stable axial movement of the panel.

Another purpose is to disclose such an acoustic panel assembly that is suitable for operating the acoustic panel in a hybrid mode, i.e. in "distributed mode" and in "pistonic mode", with a good reproduction of the low frequencies and audio band extension up to the medium-high frequencies.

Another purpose is to disclose such an acoustic panel assembly with low thickness, which is inexpensive and easy to make.

These purposes are achieved according to the invention with the characteristics of the independent claim 1.

Advantageous embodiments of the invention will appear from the dependent claims.

The acoustic panel assembly of the invention is defined in the independent claims.

BRIEF DESCRIPTION OF THE SEVERAL VIEWS OF THE DRAWINGS

Additional features of the invention will appear clearer from the following detailed description, which refers to merely illustrative, not limiting embodiments, which are illustrated in the appended drawings, wherein.

DETAILED DESCRIPTION OF THE INVENTION

Figure 1:
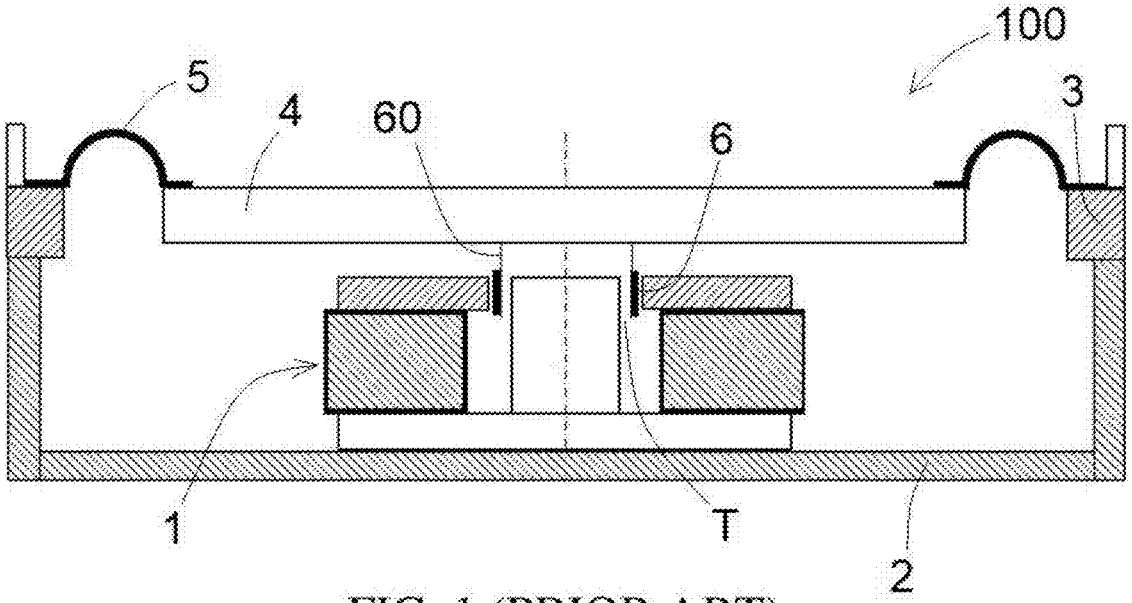
FIG. 1 (PRIOR ART)
FIG. 1 is a sectional axial view of an acoustic panel assembly according to the prior art.
Figure 2:
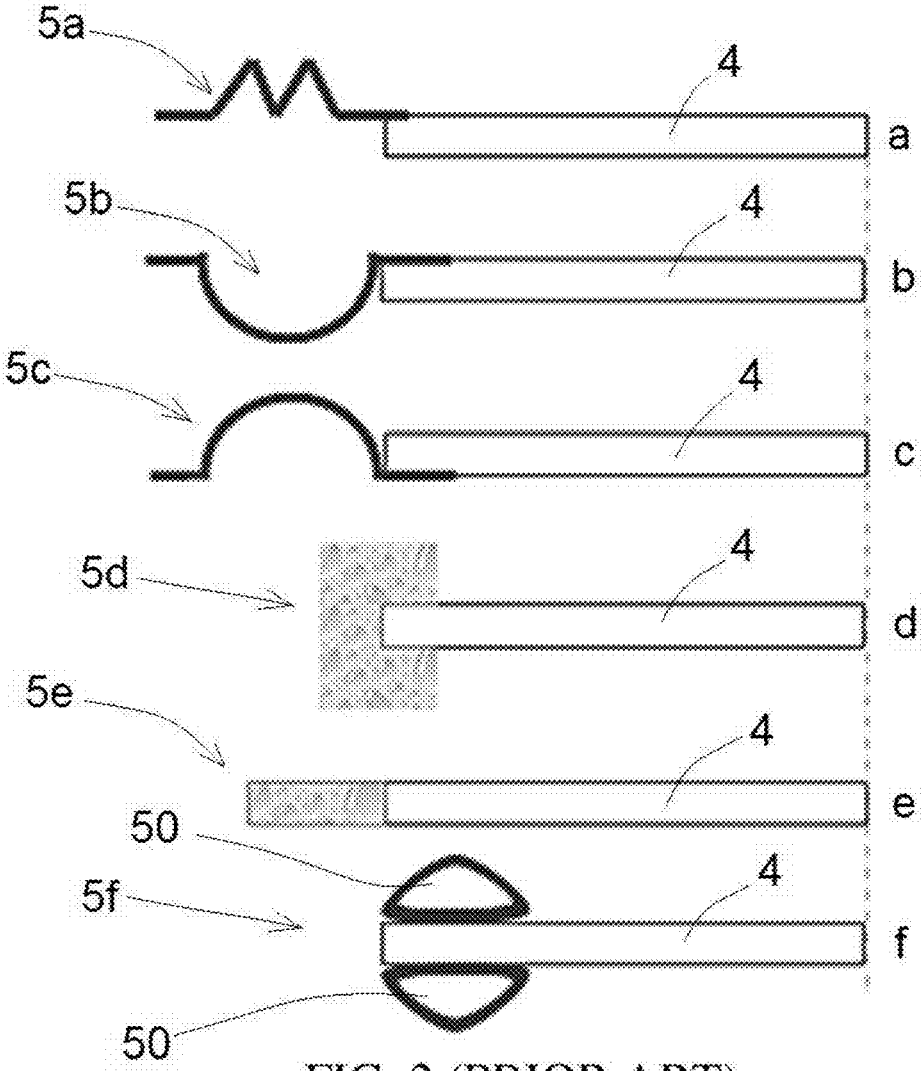
FIG. 2 (PRIOR ART)
FIG. 2 is a sectional view of six types of elastic perimeter suspensions used in acoustic panels according to the prior art.

With reference to FIGS. 3 to 12, a first embodiment of an acoustic panel assembly according to the invention is described, which is generally indicated with reference numeral 200.

Figure 3:
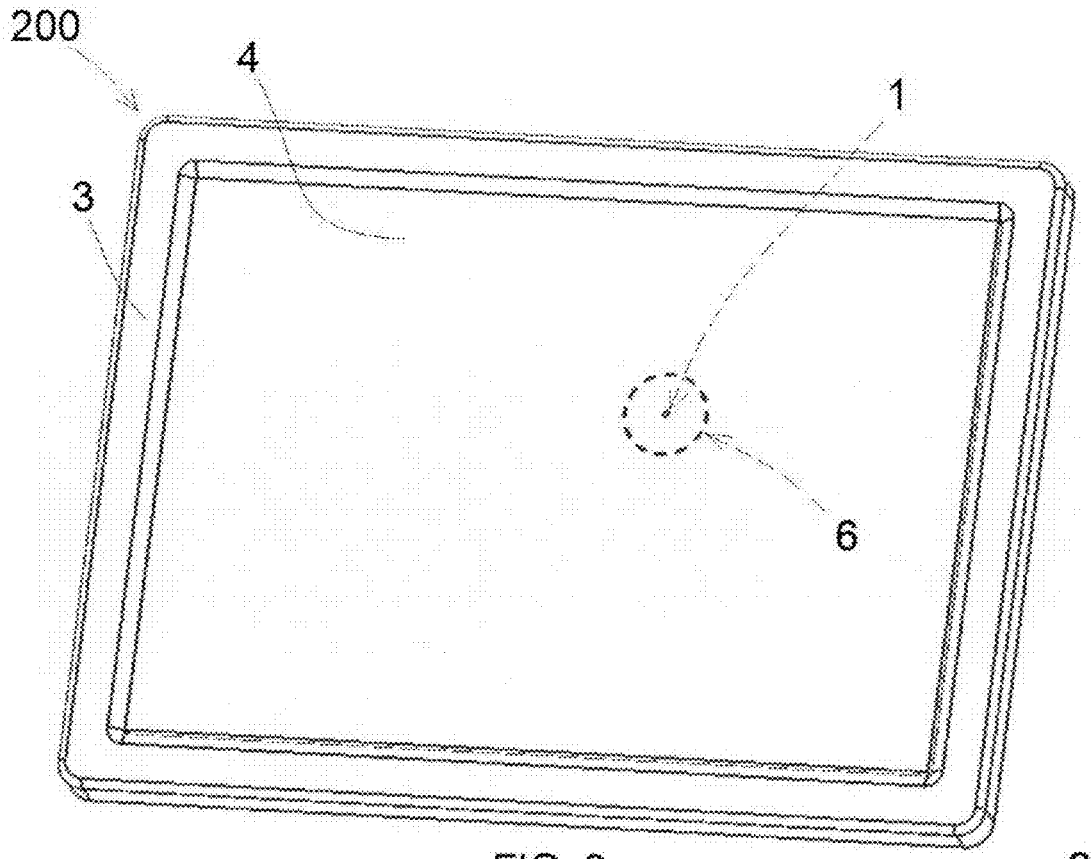
FIG. 3 is a top view of an acoustic panel assembly according to the invention.
Figure 4:
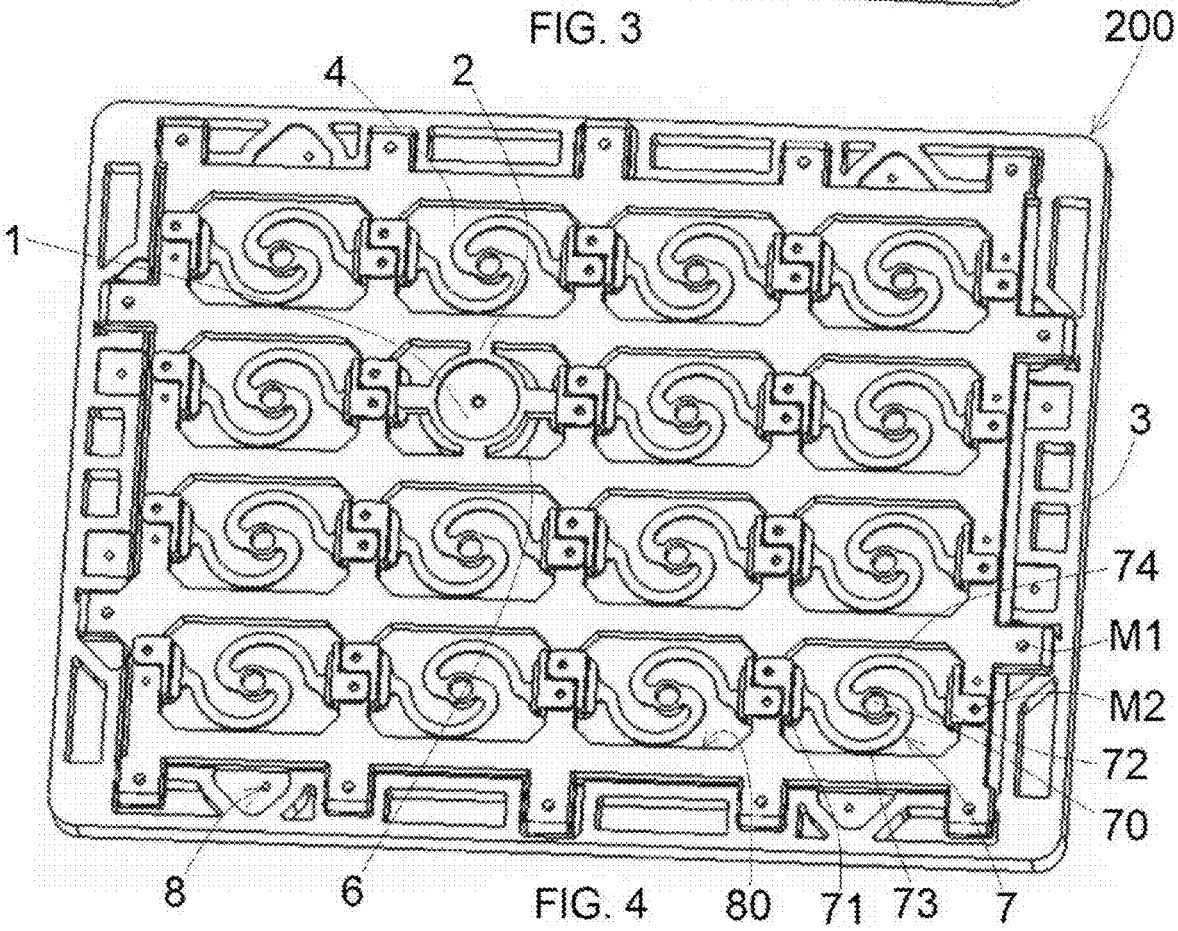
FIG. 4 is a bottom view of the acoustic panel assembly of FIG. 3.

Now with reference to FIGS. 3 and 4, the acoustic panel assembly (200) comprises:

an acoustic panel (4);

a frame (3) that peripherally surrounds the acoustic panel (4), a support (2) integral with the frame (3), a magnetic unit (1) fixed to the support (2), and a voice coil (6) fixed to the acoustic panel (4).

The frame (3) can have a rectangular shape.

Although the acoustic panel (4) is shown with a planar, rectangular shape, it may have a non-planar, non-rectangular shape. For example, the acoustic panel (4) may be composed of a portion of a vehicle that generally has a non-planar shape, such as for example the interior of a door, the cockpit, pillars and the like.

The voice coil (106) is immersed in a magnetic field generated by the magnetic unit (1). When the voice coil (6) is crossed by electrical current, it receives a Lorentz force in the gap, which causes its movement in axial direction.

A supporting structure (8) is integral with the frame (3) and a plurality of springs (7) is connected to the supporting structure. The acoustic panel has a back surface and the springs (7) elastically support the acoustic panel (4) in different points of the back surface of the acoustic panel. The springs (7) ensure an axial movement of the acoustic panel (4), especially when the magnetic unit (1) is disposed out of the center of the acoustic panel (4).

The springs (7) can have a different thickness and consequently a different rigidity. Moreover, they can have a different shape and can be disposed in different positions to ensure the balance of the mechanical moments of the acoustic panel (4) relative to two orthogonal axes passing through the center of the acoustic panel and lying on the plane of the acoustic panel.

In the example of FIG. 4, the supporting structure (8) of the springs is a grill comprising a plurality of openings (80). The springs (7) are disposed inside at least some of said openings (80). In such a case, the support (2) of the magnetic unit (1) is integral with the supporting structure (8) of the springs. In fact, the magnetic unit (1) is disposed inside an opening (80) of the supporting structure (8) of the springs.

FIG. 4 illustrates a supporting structure (8) with 16 openings (80) disposed according to a pattern of 4 lines and 4 columns. All openings (80) have the same dimensions.

The magnetic unit is disposed in an opening (80) of the supporting structure (1), and the springs (7) are disposed in all the remaining openings in such a way to uniformly cover the entire surface of the acoustic panel (4).

By means of experimental tests, each spring (7) can be connected to a dynamometer to measure the force exerted on each spring (7) during the operation of the acoustic panel assembly (200). In such a way, the effect caused on each spring by the movement of the acoustic panel (4) can be determined. If the operation of the acoustic panel is negatively affected by some of the springs (7), the possibility of eliminating some springs or the possibility of changing the elasticity coefficient of some springs can be considered, using a spring with a different shape, a different material or a different thickness compared to the other springs, in such a way to obtain an optimal operation of the acoustic panel assembly.

FIG. 4 illustrates a supporting structure (8) fixed to the frame (3) by means of fixing means (M1), such as screws. Obviously, the fixing means (M1) of the supporting structure can consist in gluing, welding or fitting. Alternatively, the supporting structure (8) can be obtained in one piece with the frame (3).

FIG. 4 illustrates springs (7) fixed to the supporting structure (8) by means of fixing means (M2), such as screws. Obviously, the fixing means (M2) of the springs can consist in gluing, welding or fitting. Alternatively, the springs (7) can be obtained in one piece with the supporting structure (8).

For illustrative purposes, each spring (7) comprises:

a central portion (70) fixed to the acoustic panel (4); and two peripheral portions (71, 72) fixed to the supporting structure (8) in diametrically opposite positions relative to the central portion (70).

The central portion (70) is connected to the peripheral portions (71, 72) by means of two arms (73, 74) with a curved shape, such as a C-shape, in such a way that the spring has an S-shape.

In the example of FIG. 4, the springs (7) are all disposed in the same direction; i.e. in each spring the straight line passing through the peripheral portions (71, 72) and the central portion (70) of the spring is always parallel to one side of the frame (3).

Figure 5:
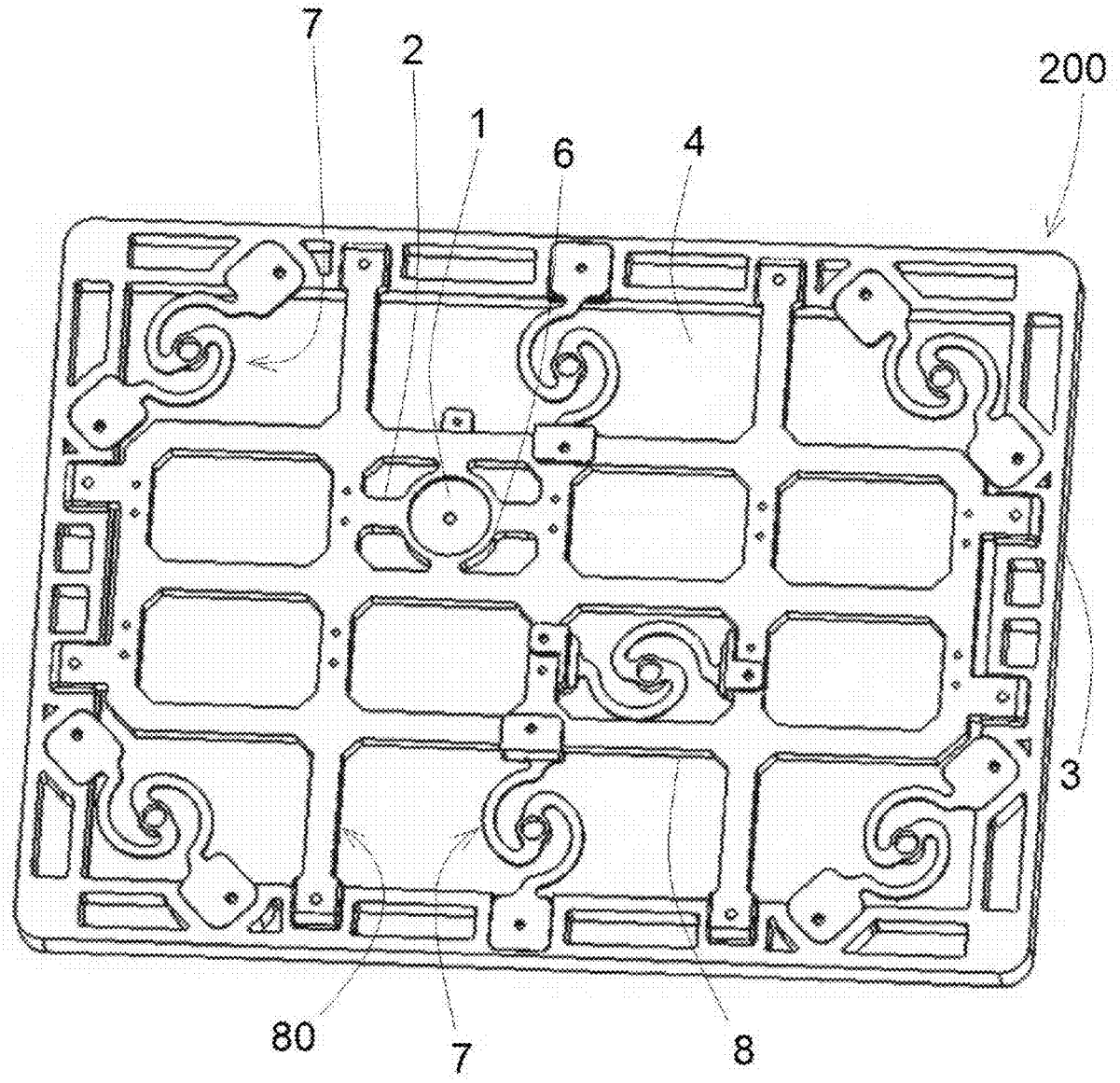
FIG. 5 is the same view as FIG. 4, which illustrates a variant of the supporting structure.

FIG. 5 illustrates a variant, wherein the openings (80) of the supporting structure (8) have different dimensions and the springs (7) are disposed only in some of the openings (80).

Some springs are connected to the supporting structure (80) and to the frame (3).

Some springs (7) are angularly connected only to the frame (3). In such a case, the straight line passing through the peripheral portions (71, 72) and the central portion (70) of the spring is inclined by 45° relative to the sides of the frame (3).

The springs (7) can be made of the same plastic material as the frame (3) and the supporting structure (8). Alternatively, the springs (7) can be made of a plastic material that is different from the plastic material of the frame (3) and the supporting structure (8) by means of co-molding techniques. A different thickness and a different shape of the springs can be easily obtained with the plastic injection technology in order to obtain differentiated elastic forces in the different areas of the acoustic panel (4). In any case, the manufacturing cost of the springs can be reduced with the molding or co-molding technology.

The springs (7) can be metal springs, can be applied to or co-molded with the supporting structure (8). If metal springs are used, the choice of a different thickness or shape determines the distribution of differentiated forces on the back surface of the acoustic panel.

Figure 6:
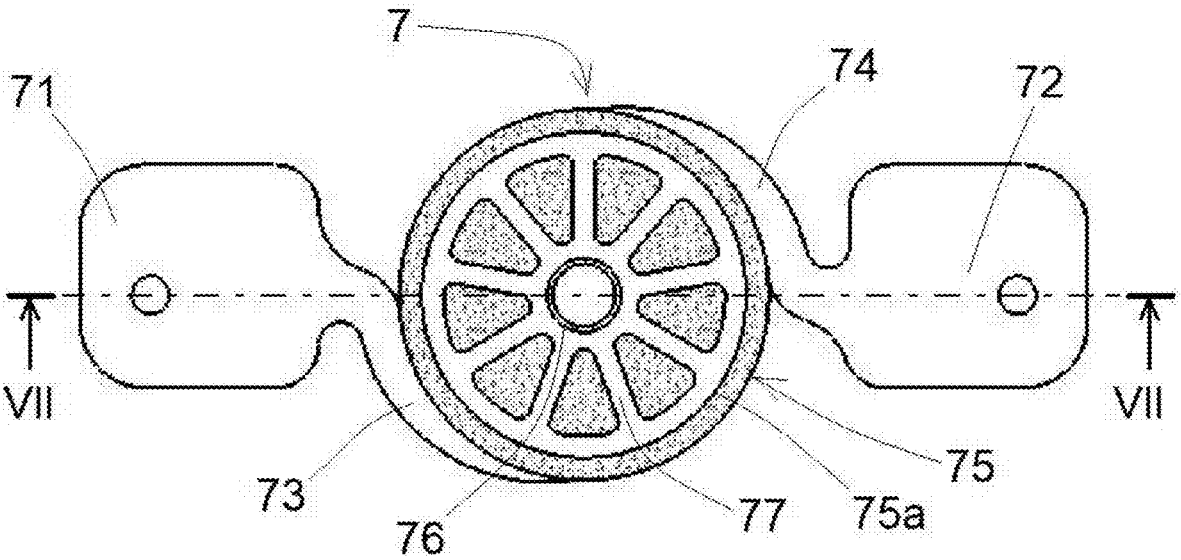
FIG. 6 is a plan view of a variant of a spring of the supporting structure.
Figure 7:
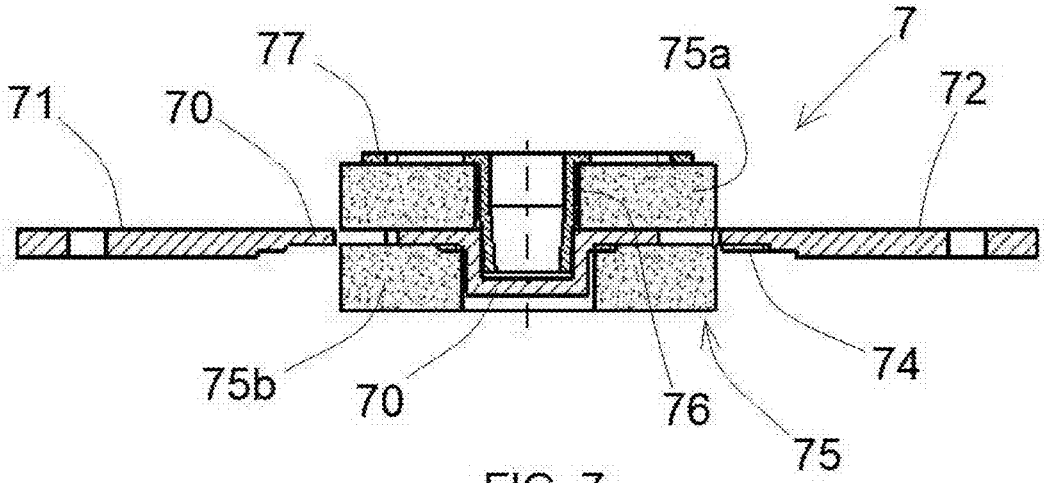
FIG. 7 is an axial view taken along the sectional plane VII-VII of FIG. 7.

FIGS. 6 and 7 illustrate an improvement of the spring (7) that provides for damping means (75) suitable for dampening the undesired elastic oscillations of the spring. The damping means (75) comprise two dampers (75*a*, 75*b*) with disc-like shape disposed above and under the springs (7). Each damper (75*a*, 75*b*) is made of soft elastic material, such as rubber, foam or silicone.

The first damper (75*a*) is disposed around the central portion (70) of the spring and is held by means of a lid comprising a shank (76) that is engaged in the central portion (70) of the spring and a flange (77) that radially protrudes from the shank (76) in order to hold the damper (75). The second damper (75*b*) is disposed between the acoustic panel (4) and the spring (7).

Figure 8:
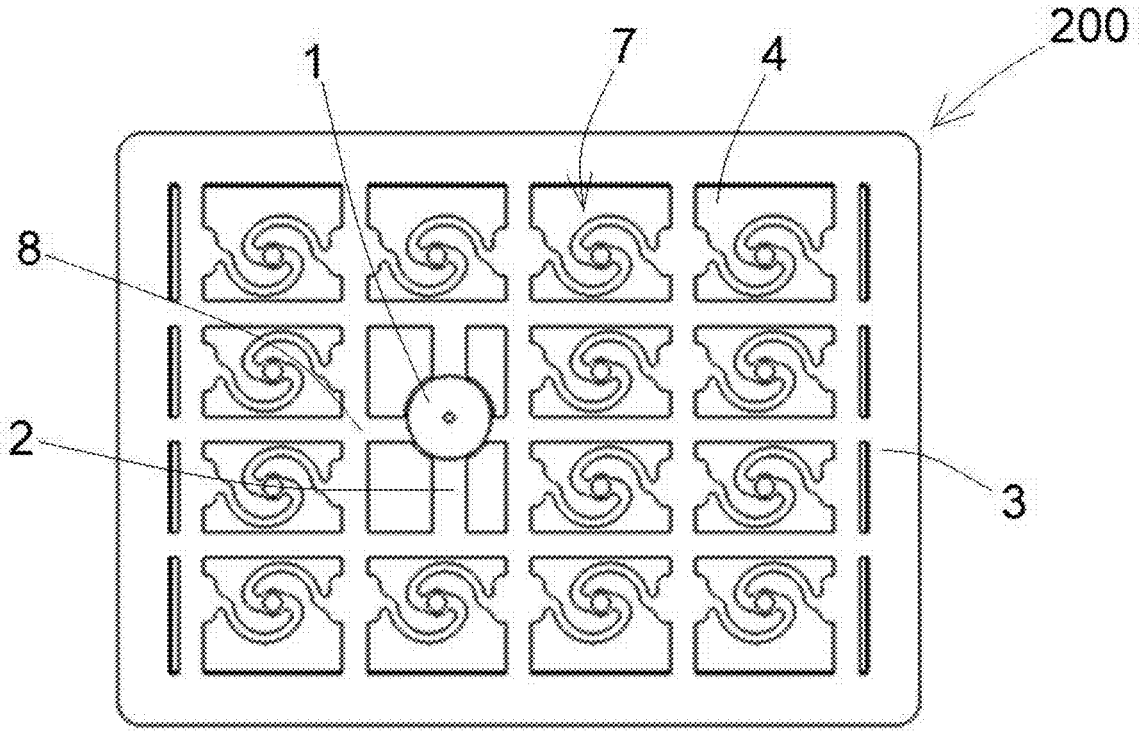
FIGS. 8 and 9 are bottom views of embodiments of the acoustic assembly panel wherein the springs of the supporting structure are molded in one piece with the supporting structure.
Figure 9:
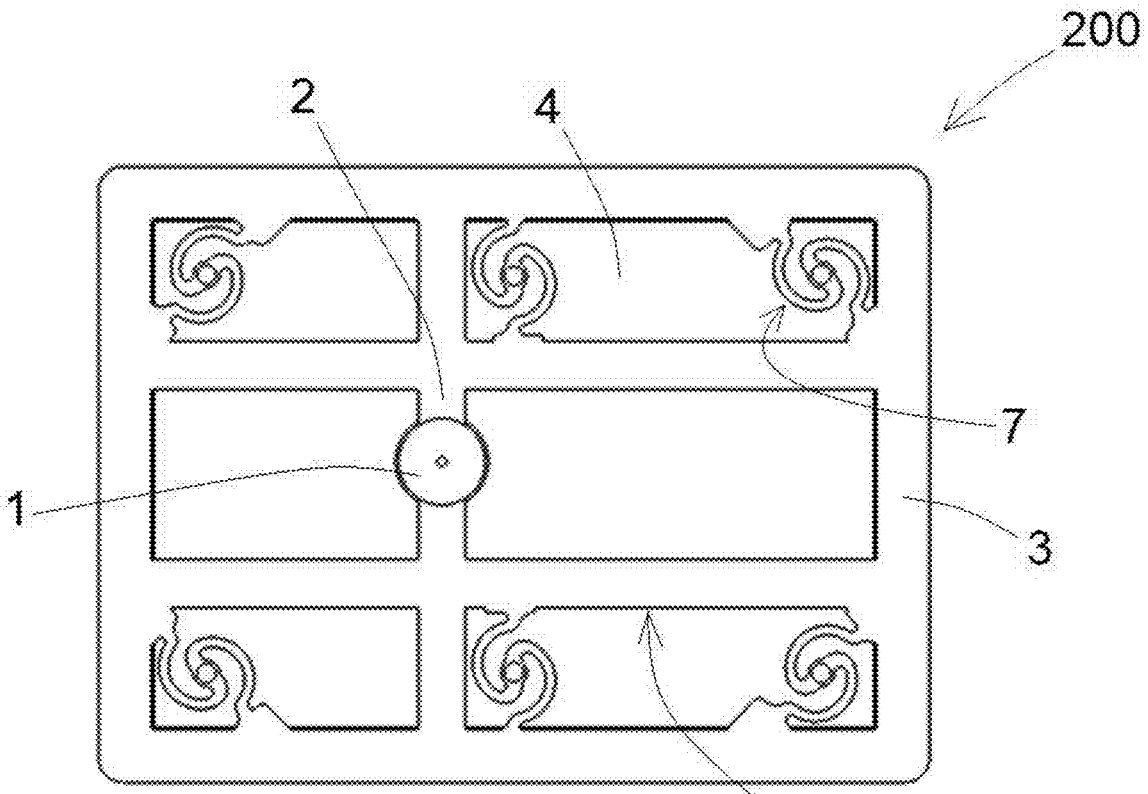
Figure 10:
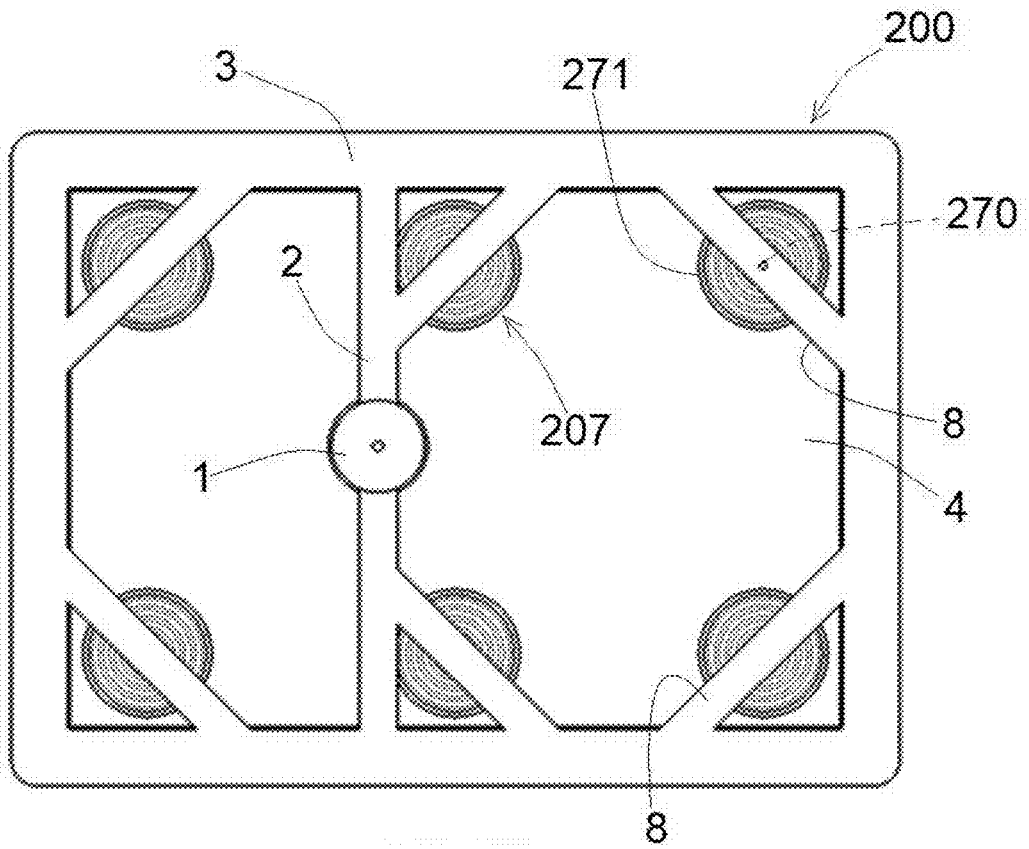
FIG. 10 is a bottom view of the acoustic panel assembly that illustrates a second embodiment of the springs of the supporting structure.

FIGS. 8 and 9 illustrate two embodiments of the acoustic panel assembly (200), wherein the frame (3), the support (2), the supporting structure (8) and the springs (7) are made in one piece by means of plastic injection molding.

Figure 13:
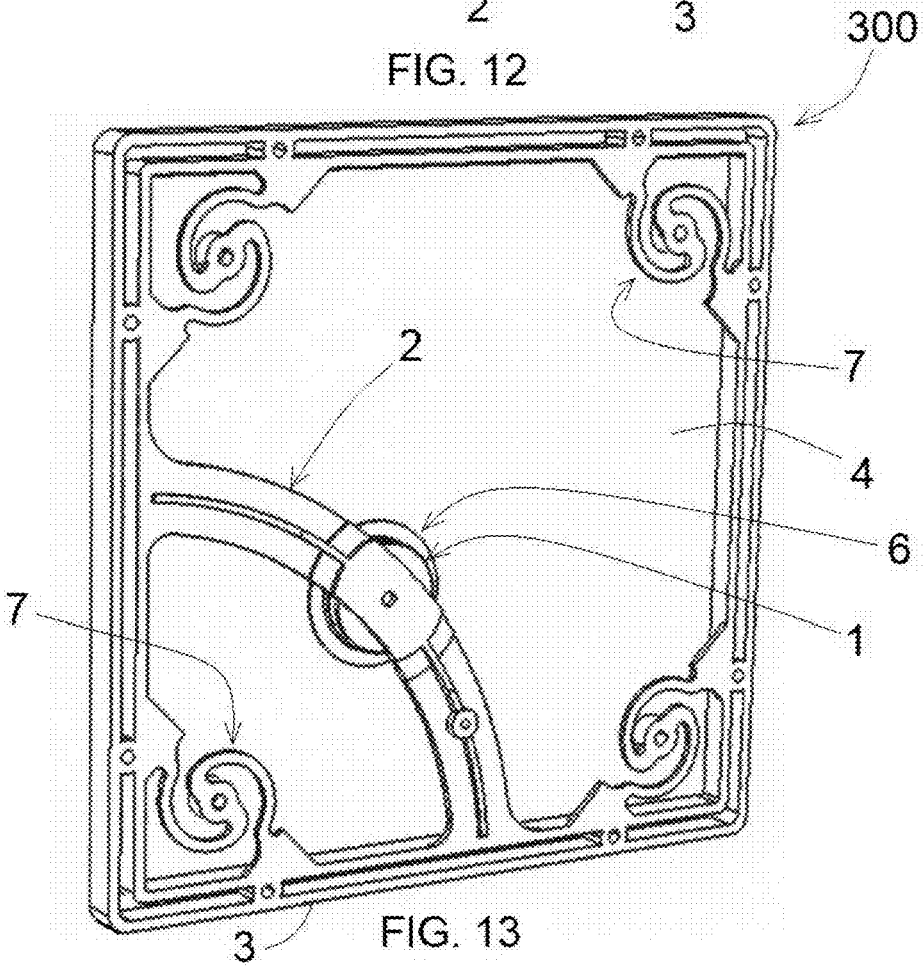
FIG. 13 is a bottom view of a second embodiment of the acoustic panel assembly, wherein the springs are connected to a frame.

FIG. 13 illustrates springs (207) according to a second embodiment. In such a case, the springs (207) consist in spiders, which are normally used to elastically support a voice coil of a loudspeaker. The spring (207) has a disc-like shape with a wavy cross-section. The spring (207) has a central portion (270) fixed to the supporting structure (8) and a peripheral annular portion (271) fixed to the acoustic panel (4). In such a case, the supporting structure (8) comprises brackets connected to the frame (3) and to the support (2) of the magnetic unit.

Figure 11:
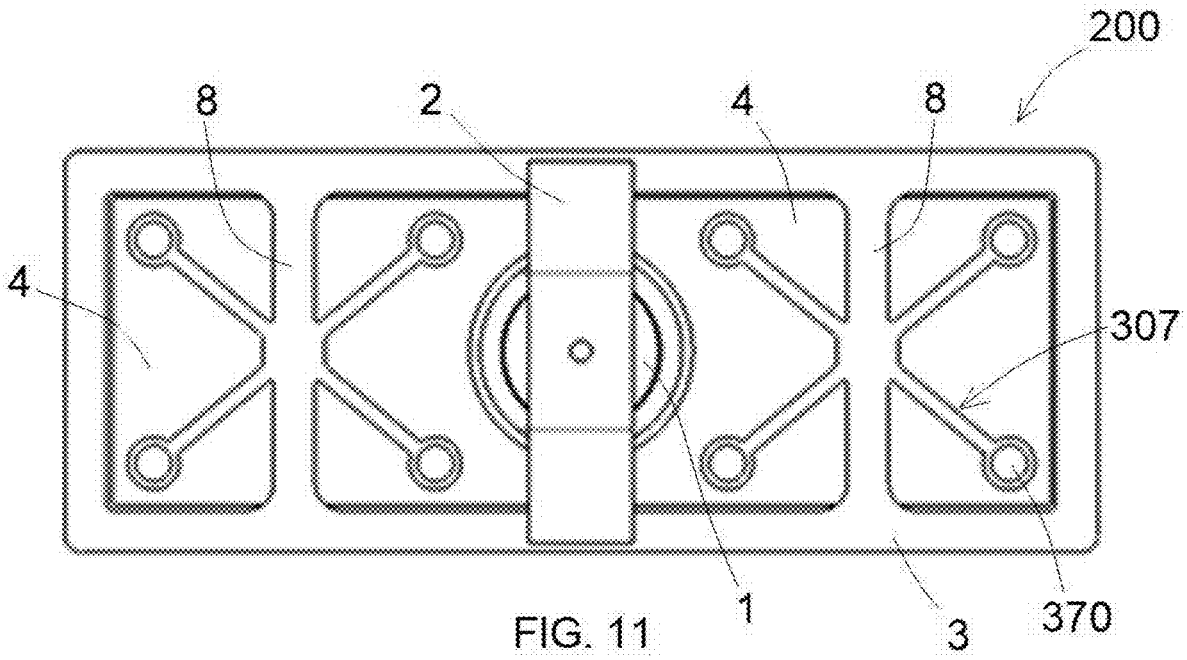
FIGS. 11 and 12 are bottom views of the acoustic panel assembly that illustrate a third embodiment of the springs of the supporting structure.
Figure 12:
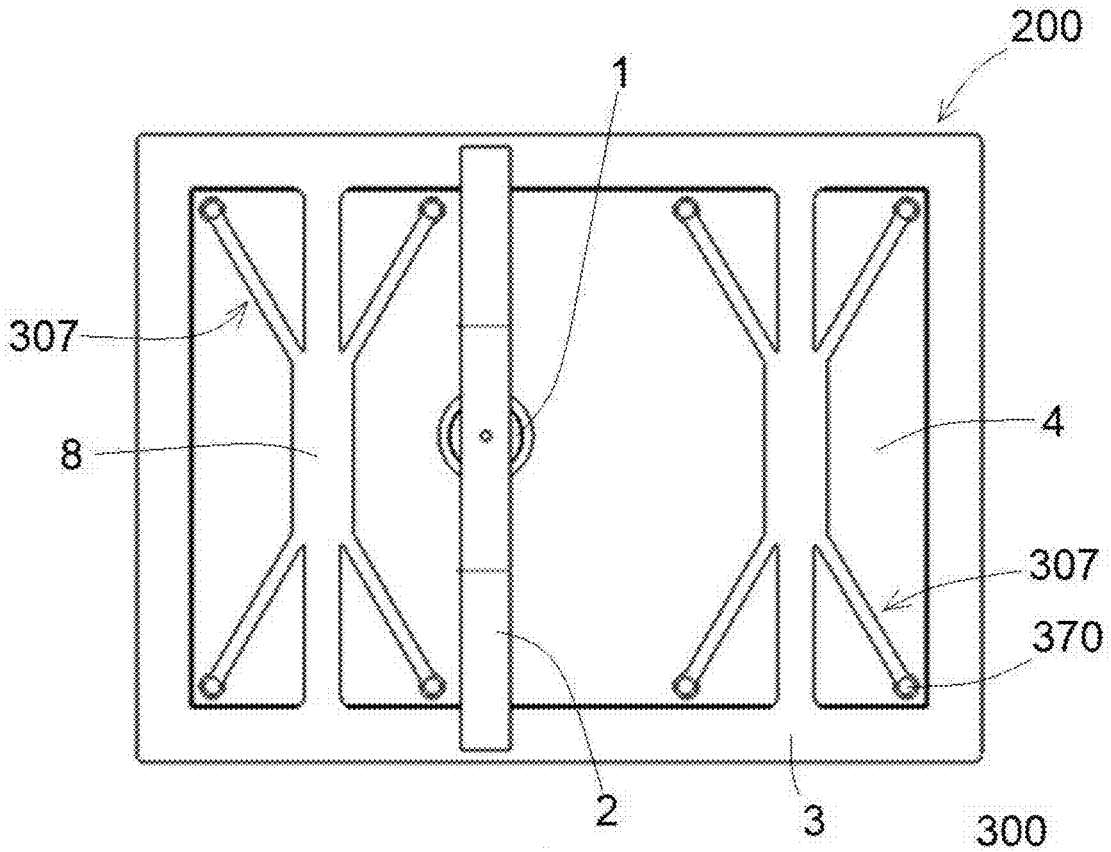

FIGS. 11 and 12 illustrate springs (307) according to a third embodiment. In such a case, rectilinear elastic tabs, which act as springs (307), protrude from the supporting structure (8). One end (370) of each spring (307) is fixed to the acoustic panel (4).

FIG. 13 illustrates an acoustic panel assembly (300) according to a second embodiment, wherein the springs (7) are connected to the frame (3) and to the acoustic panel (4). The support (2) is a curved bracket connected to the frame (3). In such a case, the springs (7) are only connected to the frame (3) in correspondence of the four corners of the frame (3) and no supporting structure of the springs is provided.

Figure 14:
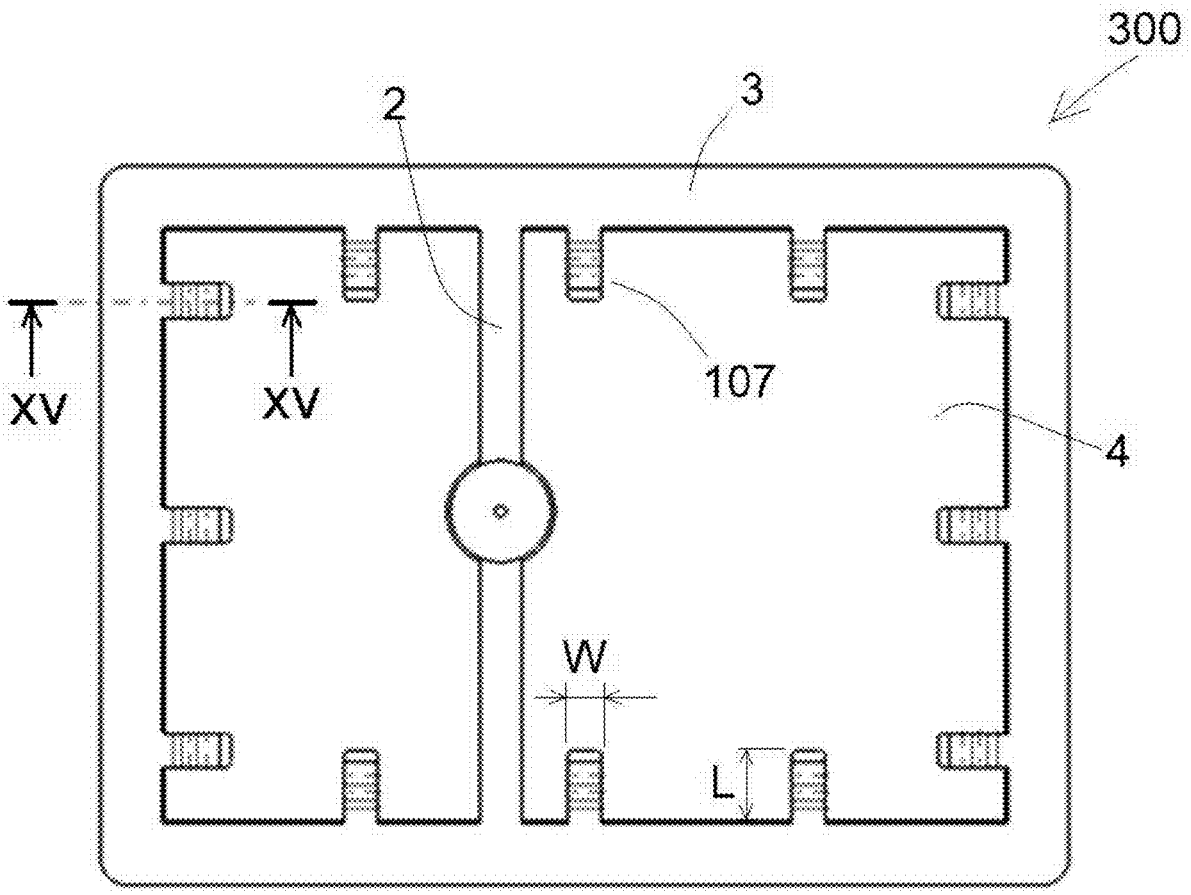
FIG. 14 is a bottom view of a variant of the acoustic panel assembly of FIG. 13, which illustrate elastic tabs that act as springs.
Figure 15:
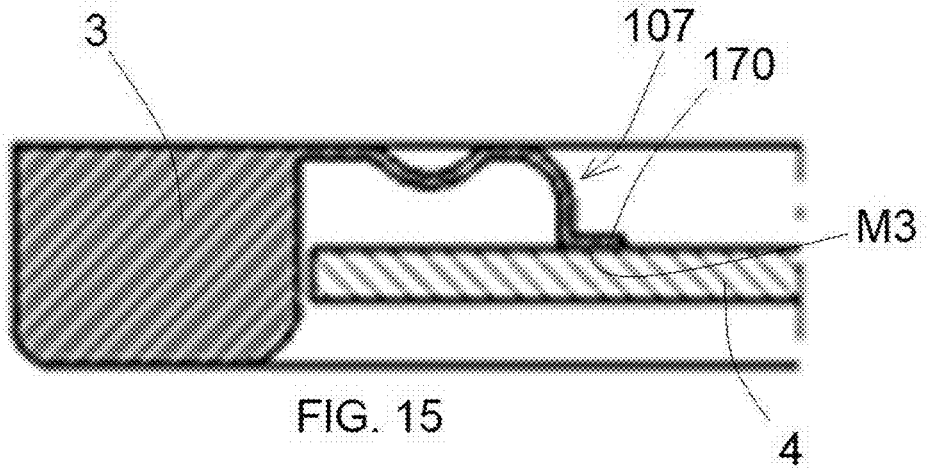
FIG. 15 is a sectional view taken along the sectional plane XV-XV of FIG. 14.

FIGS. 14 and 15 illustrate a variant of the acoustic panel assembly (300) of FIG. 13, wherein elastic tabs, which act as springs (107), protrude from the frame (3) towards the acoustic panel (4) and behind the acoustic panel (4). The spring (107) has a wavy shape and a planar ending section (170) fixed to the acoustic panel (4) by means of fixing means (M3), such as gluing or welding. The spring (107) has a length (L1) and a width (W) that are chosen according to the areas of the acoustic panel (4) to be elastically supported.

Figure 16:
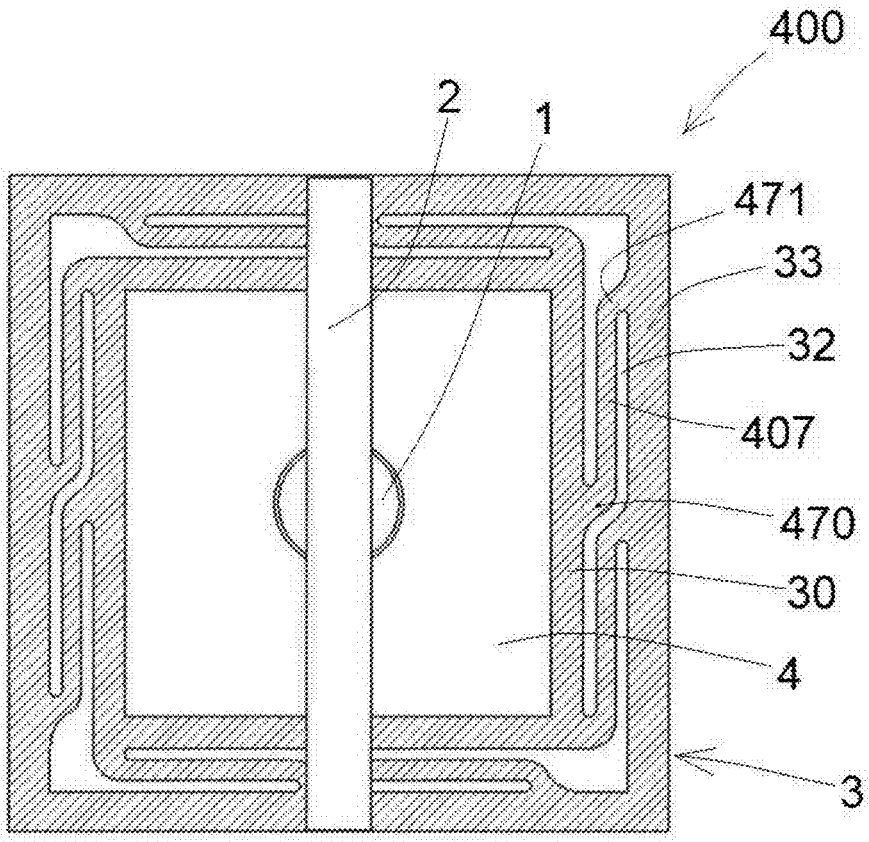
FIG. 16 is a bottom view of a third embodiment of the acoustic panel assembly, wherein elastic arms, which act as springs, are obtained in the frame.

FIG. 16 illustrates an acoustic panel assembly (400) according to a third embodiment. In such a case, elastic arms, which act as springs (407), elastically connect a peripheral portion (33) of the frame to a central portion (30) of the frame fixed to the acoustic panel (4). Said elastic arms that act as springs (407) are obtained by means of through notches (31, 32) in the frame. Each elastic arm that acts as spring (407) has an internal portion (470) connected to the central portion (30) of the frame and an external portion (471) connected to the peripheral portion (33) of the frame.

The elastic arms that act as springs (407) can be integrally obtained with the frame (3), for example, by means of injection molding or co-molding in the same material as the frame (3) or in a different material.

Figure 17:
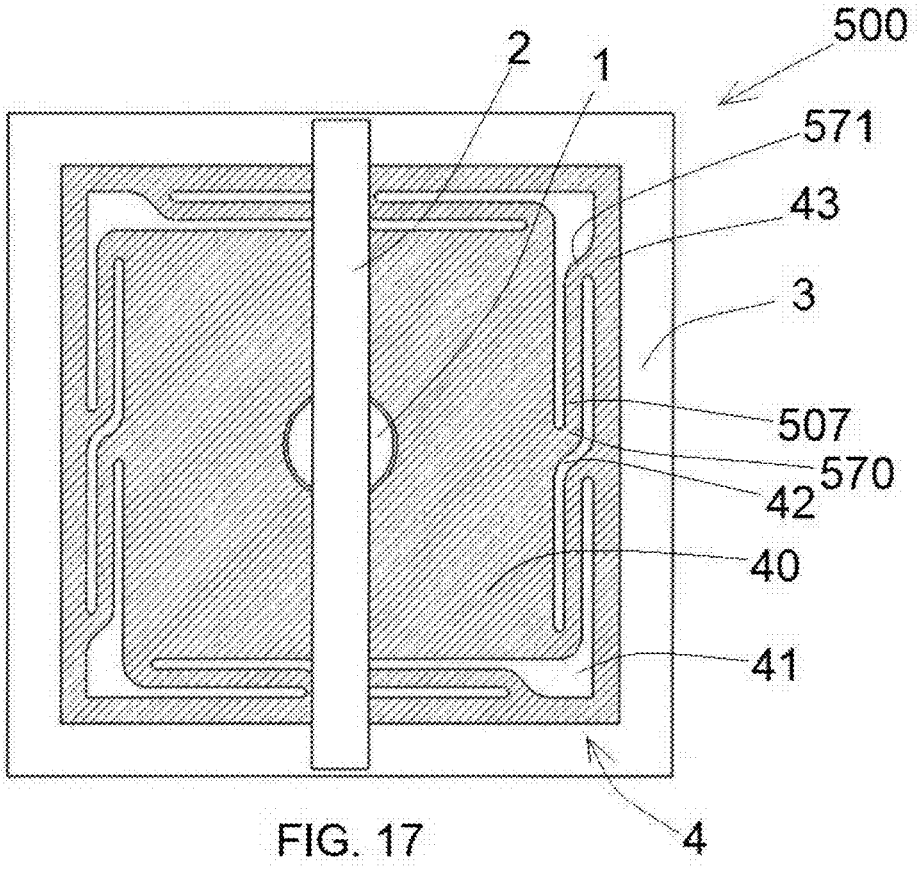
FIG. 17 is a bottom view of a fourth embodiment of the acoustic panel assembly, wherein elastic arms, which act as springs, are obtained in a peripheral portion of the acoustic panel.

FIG. 17 illustrates an acoustic panel assembly (500) according to a fourth embodiment.

In such a case, elastic arms that act as springs (507) elastically connect a central portion (40) of the acoustic panel to a peripheral portion (4*e*) of the acoustic panel (4) fixed to the frame (3). Said elastic arms that act as springs (507) are obtained by means of through notches (41, 42) in the acoustic panel. Each elastic arm that acts as spring (407) has an internal portion (570) connected to the central portion (40) of the acoustic panel, and an external portion (571) connected to the peripheral portion (43) of the acoustic panel.

Numerous equivalent variations and modifications can be made to the present embodiments of the invention, which are within the reach of an expert of the field and fall in any case within the scope of the invention as disclosed by the appended claims.

I claim:

1. An acoustic panel assembly comprising:
- only one acoustic panel having a back surface;
- a frame peripherally surrounding said only one acoustic panel;
- a support integral with said frame;
- only one magnetic unit fixed to said support;
- only one voice coil fixed to said only one acoustic panel;
- a supporting structure integral with said frame;
- a plurality of springs connected to said supporting structure, said plurality of springs being connected at different points of the back surface of said only one acoustic panel so as to elastically support said only one acoustic panel, wherein said supporting structure has a grill shape with a plurality of openings, said plurality of springs being disposed in at least some openings of said plurality of openings of said supporting structure.

2. The acoustic panel assembly of claim 1, wherein the plurality of openings of said supporting structure are disposed in a pattern of lines and a pattern of columns, all of the plurality of openings having identical dimensions, said only one magnetic unit being disposed in one opening of the plurality of openings, said plurality of springs being disposed in remaining openings of the plurality of openings.

3. The acoustic panel assembly of claim 1, wherein said support is integral with said supporting structure, said only one magnetic unit being disposed in one opening of the plurality of openings of said supporting structure.

4. The acoustic panel assembly of claim 1, wherein said plurality of springs are integrally formed as one piece with said supporting structure.

5. The acoustic panel assembly of claim 1, wherein each spring of said plurality of springs has a damper formed of a soft and elastic material, the damper being disposed above and below each spring.

6. An acoustic panel assembly comprising:
- only one acoustic panel having a back surface;
- a frame peripherally surrounding said only one acoustic panel;
- a support integral with said frame;
- only one magnetic unit fixed to said support;
- only one voice coil fixed to said only one acoustic panel;
- a supporting structure integral with said frame;
- a plurality of springs connected to said supporting structure, said plurality of springs being connected at different points of the back surface of said only one acoustic panel so as to elastically support said only one acoustic panel, wherein each spring of said plurality of springs comprises:
  - a central portion fixed to said only one acoustic panel;
  - a pair of peripheral portions fixed to said support structure in diametrically opposite positions relative to said central portion; and
  - a pair of arms each having a curved shape, said pair of arms connecting said central portion with said pair of peripheral portions.

7. An acoustic panel assembly comprising:
- only one acoustic panel having a back surface;
- a frame peripherally surrounding said only one acoustic panel;
- a support integral with said frame;
- only one magnetic unit fixed to said support;
- only one voice coil fixed to said only one acoustic panel;
- a supporting structure integral with said frame;

a plurality of springs connected to said supporting structure, said plurality of springs being connected at different points of the back surface of said only one acoustic panel so as to elastically support said only one acoustic panel, wherein each spring of said plurality of springs has a centering device having a disc shape with a wavy cross-section and having a central portion fixed to said supporting structure and having a peripheral annular portion fixed to said only one acoustic panel.

8. An acoustic panel assembly comprising:

only one acoustic panel having a back surface;

a frame peripherally surrounding said only one acoustic panel;

a support integral with said frame;

only one magnetic unit fixed to said support;

only one voice coil fixed to said only one acoustic panel;

a supporting structure integral with said frame;

a plurality of springs connected to said supporting structure, said plurality of springs being connected at different points of the back surface of said only one acoustic panel so as to elastically support said only one acoustic panel, wherein said supporting structure has a plurality of rectilinear elastic tabs which protrude from said supporting structure, the plurality of rectilinear elastic tabs each having one end fixed to said only one acoustic panel.

9. The acoustic panel assembly of claim 2, wherein each spring of said plurality of springs is connected to a dynamometer so as to measure a force exerted on each spring during operation of the acoustic panel assembly.

* * * * *